United States Patent [19]

Newton

[11] 3,935,715

[45] Feb. 3, 1976

[54] VAPOR CONDENSER FOR A REFRIGERATION SYSTEM

[75] Inventor: Alwin B. Newton, York, Pa.

[73] Assignee: Borg-Warner Corporation, Chicago, Ill.

[22] Filed: June 26, 1974

[21] Appl. No.: 483,194

[52] U.S. Cl. ..... 62/475; 62/507; 62/85; 165/111; 165/174

[51] Int. Cl.[2] ..... F25B 43/04; F25B 39/04

[58] Field of Search ..... 62/506, 507, 475, 195, 62/85; 165/111, 110, 122, 174

[56] References Cited

UNITED STATES PATENTS

| | | | |
|---|---|---|---|
| 341,591 | 5/1886 | McCann | 165/111 X |
| 2,986,894 | 6/1961 | Endress et al. | 62/195 X |
| 3,478,529 | 11/1969 | Boykin | 62/475 X |
| 3,710,854 | 1/1973 | Staub | 165/111 |

*Primary Examiner*—Albert W. Davis, Jr.
*Attorney, Agent, or Firm*—James E. Tracy

[57] ABSTRACT

A series of air-cooled, vertical condensing tubes extend upwardly from a horizontal header to which refrigerant vapor is supplied. The vapor flows upwardly from the header through the condensing tubes and forms, on the tubes' internal surfaces, condensate which then flows downwardly into the header and eventually through the header's outlet. With this arrangement, the customary top header is not needed.

1 Claim, 2 Drawing Figures

VAPOR CONDENSER FOR A REFRIGERATION SYSTEM

BACKGROUND OF THE INVENTION

A vapor condenser of the type having vertical condensing tubes is usually constructed with a top header across the upper ends of the tubes and a bottom header across the lower ends. Refrigerant vapor enters the top header and flows downwardly through the tubes, condensing on the tubes' internal surfaces and running into the bottom header from which it leaves the condenser.

The vapor condenser of the present invention also has vertical condensing tubes but is of much simpler construction and considerably less expensive then the prior vertical condensers.

SUMMARY OF THE INVENTION

The vapor condenser of the invention includes a horizontal header and a plurality of air-cooled, generally vertical condensing tubes that extend upwardly from and communicate with the header. There is an inlet for the header for supplying refrigerant vapor to the lower ends of the condensing tubes, the vapor flowing upwardly through the condensing tubes and forming on the tubes' internal surfaces condensate which then flows downwardly into the header. An outlet for the header provides the condensed vapor.

DESCRIPTION OF THE DRAWING

The features of the invention which are believed to be novel are set forth with particularity in the appended claims. The invention, together with further advantages and features thereof, may best be understood, however, by reference to the following description in conjunction with the accompanying drawing in which:

DESCRIPTION OF THE ILLUSTRATED EMBODIMENT

Figure 1:
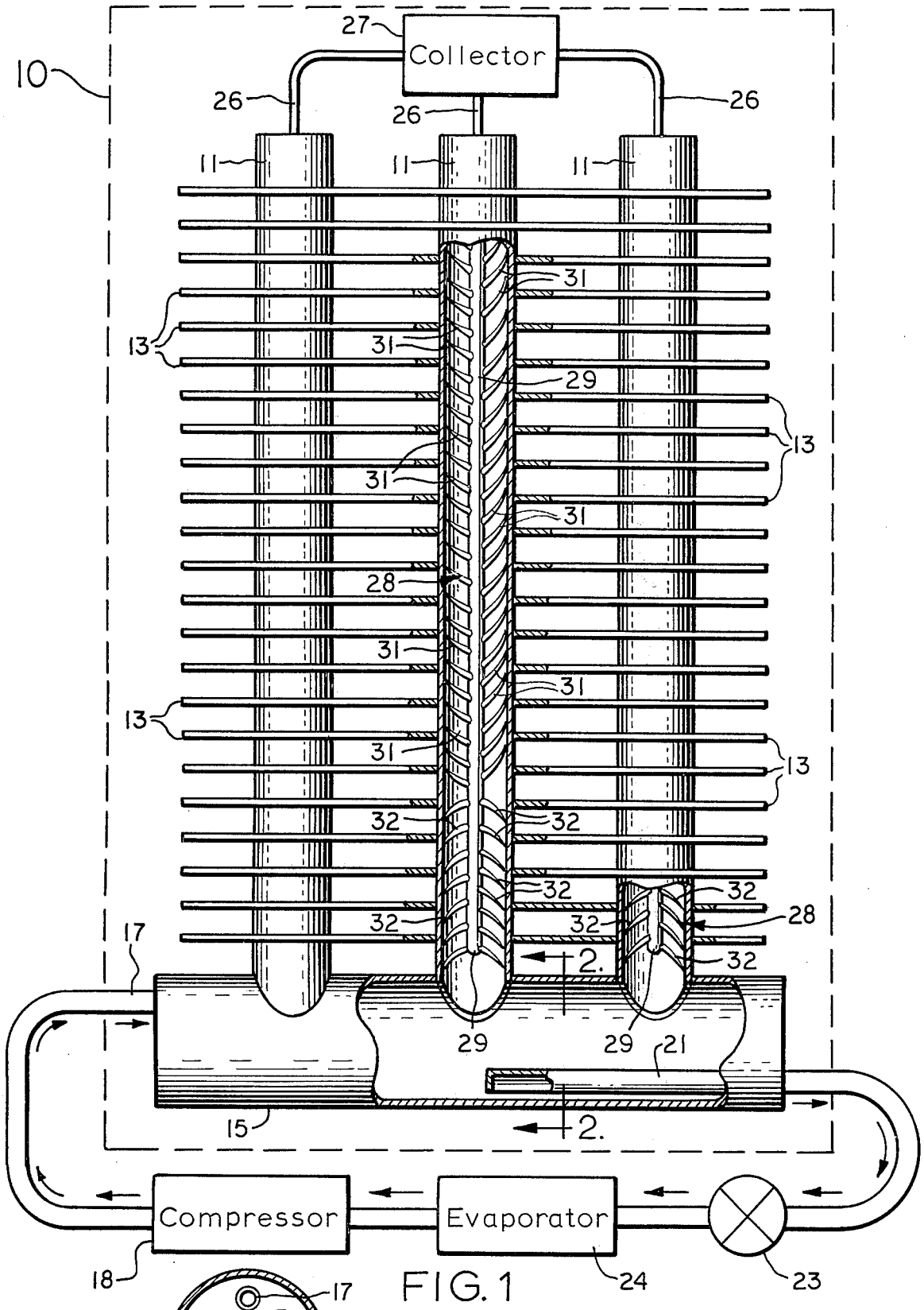
FIG. 1 is a schematic representation, with portions broken away and in section, of a refrigeration system having a vapor condenser constructed in accordance with the invention; and, FIG. 2 is a sectional view of part of the system of FIG. 1 and taken along the plane of section line 2—2 in FIG. 1.

The disclosed refrigeration system, which may constitute an air conditioning system, includes a vapor condenser 10 having a series of cylindrically shaped vertical condensing tubes 11. Of course, only three such tubes are shown to avoid unduly encumbering the drawing. Preferably, the condensing tubes are air-cooled which is facilitated by a series of parallel, planar cooling fins 13 attached in heat exchange relationship to the external surfaces of tubes 11. The lower ends of the vertical condensing tubes are open and communicate with a cylindrically shaped horizontal header 15.

Figure 2:
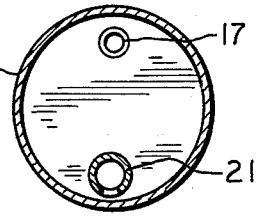

Refrigerant gas or vapor is received at inlet 17 from compressor 18 and flows through the header and upward through condensing tubes 11. Air is directed, by a fan (not shown), around the outside of the condensing tubes and between fins 13 so that sufficient heat is removed from the vapor to cause it to condense on the internal surfaces of the tubes. In a manner to be explained, the condensed vapor or condensate is guided downwardly through each condensing tube to the bottom of header 15. A cylindrically shaped outlet 21 extends into header 15 a substantial distance and is slotted or open along its bottom (see FIG. 2) so that only liquid refrigerant or condensate is drawn from the header and supplied to expansion device 23 where it expands and emerges as a mixture of liquid and gas but primarily a liquid. As the mixture then flows through evaporator 24, which is in heat exchange relation or contact with the medium to be cooled, heat is transferred from the medium to the refrigerant and the entirety of the refrigerant assumes its gaseous state. It is then compressed by compressor 18 to provide the refrigerant vapor for inlet 17.

The top ends of condensing tubes 11 are closed except for small vents that are coupled through capillary type tubes 26 to a common collector 27. This arrangement provides for purging of any non-condensible components from the refrigerant vapor that flows upwardly through tubes 11. Preferably, these non-condensibles are released into the atmosphere from collector 27, although if desired they could be pumped back into the refrigeration system and recirculated. As is now apparent, and in accordance with the invention, no expensive top header is necessary.

Turning now to the condensate guiding apparatus, inserted in each of the condensing tubes is a tree-like structure or apparatus 28 having a vertical trunk 29 that extends longitudinally within and is coaxial with the tube. Attached to the upper portion of trunk 29 (roughly the upper three-fourths of the trunk) is a series of flexible bristlelike branches or spires 31 which surround the trunk in a random pattern and extend upwardly and outwardly to establish point contacts with the tube's internal surface. Branches 31 may be of different lengths and extend at different angles from trunk 29. Moreover, they may be made of metal, nylon, plastic or any suitable material. Their purpose is to pick off, by capillary action and gravity, the condensed vapor or condensate from the tube's internal surface. Once the condensate is removed from the internal surface, it is guided downwardly along branches 31 to trunk 29 and thence downwardly along the trunk and eventually to the bottom of header 15. By stripping the condensate from the internal surfaces, the heat transferred from the refrigerant to the cooling medium on the outside of the tubes will be maximized thereby enhancing the condensation process.

Each guiding apparatus 28 is preferably made with spires or branches 31 of a length greater than the radius of the condensing tube in which it is incorporated. The branches are preferably initially constructed so as to be roughly perpendicular to trunk 29 and assume their depicted orientation during the assembly of the tube when apparatus 28 is inserted into the tube from its upper end. This method has the advantage of providing a secure mounting of apparatus 28 within the tube as well as providing a good point contact, with a positive capillary attraction, between the free ends of the branches and the tube's internal surface.

The lowermost branches 32 of each apparatus 28 are angled so that they extend downwardly and outwardly from trunk 29 and in point contact with the tube's internal surface. With this orientation for branches 32, some of the condensate removed by branches 31 and flowing down trunk 29 will be guided along branches 32 and returned to the tube's internal surface. The returned condensate is thus subjected to additional cooling or sub-cooling so that it arrives at the bottom of header 15, and ultimately to expansion device 23 and evaporator 24, with a heat content much lower than it otherwise would have in the absence of the invention. As a result, more heat can be transferred to the refrigerant from the medium to be cooled.

Preferably, branches 32 and branches 31 are similarly shaped and are made of the same material. One convenient method for assembling each condensate guiding apparatus 28 to its associated condensing tube is to insert the apparatus into the tube from the top and push it downwardly until all of the lowermost branches 32 are below the lower end of the tube. Apparatus 28 is then retracted upwardly to the position shown in the drawing. In this way, all of the branches will be angled as desired.

The invention provides, therefore, a uniquely constructed vertical condenser that requires no costly top header.

Certain features described in the present application are disclosed and claimed in copending application Ser. No. 483,195, filed concurently herewith in the name of Alwin B. Newton, and issued Sep. 9, 1975 as U.S. Pat. No. 3,903,962 and assigned to the present assignee.

While a particular embodiment of the invention has been shown and described, modifications may be made, and it is intended in the appended claims to cover all such modifications as may fall within the true spirit and scope of the invention.

I claim:

1. In a refrigeration system where refrigerant flows through a vapor compression refrigeration cycle having, in closed series flow relationship and in the order named, an evaporator, a compressor, a vapor condenser and an expansion device, the refrigerant flowing in its vapor state from the evaporator and through the compressor to the condenser wherein it is condensed to refrigerant condensate for delivery to the expansion device, the vapor condenser comprising:

a cylindrically-shaped horizontal header;

a plurality of air-cooled, cylindrically-shaped, generally vertical condensing tubes extending upwardly from and communicating with said header;

an inlet for said header for receiving the refrigerant vapor from the compressor and for supplying it to the lower ends of said condensing tubes, the refrigerant vapor flowing upwardly through said condensing tubes and forming, on the tubes' internal surfaces, the refrigerant condensate which then flows downwardly into said header;

a cylindrically-shaped outlet extending into the lowest portion of said header and open along its bottom for deriving the refrigerant condensate from said header and for supplying the refrigerant condensate to the expansion device;

and purging means, including a common collector and a plurality of capillary type tubes each of which vents the upper end of a respective one of said condensing tubes to said common collector, for removing any non-condensible components from the refrigerant vapor, and non-condensible components being released into the atmosphere from said common collector.

* * * * *

UNITED STATES PATENT OFFICE

CERTIFICATE OF CORRECTION

PATENT NO. : 3,935,715

DATED : February 3, 1975

INVENTOR(S) : Alwin B. Newton

It is certified that error appears in the above-identified patent and that said Letters Patent are hereby corrected as shown below:

Column 4, line 28, after "vapor," cancel "and" and insert -- the --.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*